US006199232B1

(12) United States Patent
Kocivar

(10) Patent No.: US 6,199,232 B1
(45) Date of Patent: Mar. 13, 2001

(54) EMERGENCY CARE BLANKET

(76) Inventor: Karl Kocivar, 1055 Fillmore St., Denver, CO (US) 80206

( * ) Notice: Subject to any disclaimer, the term of this patent is extended or adjusted under 35 U.S.C. 154(b) by 322 days.

(21) Appl. No.: 08/569,999

(22) Filed: Dec. 8, 1995

(51) Int. Cl.[7] ..... A47G 9/02; A47G 9/06; A47G 9/08

(52) U.S. Cl. ..... 5/502; 5/413 R; 5/417; 5/420; 2/69.5; 24/662

(58) Field of Search ..... 5/413 R, 417, 5/419, 420, 485, 486, 502; 2/69, 69.5; 24/573.1, 662

(56) References Cited

U.S. PATENT DOCUMENTS

| | | | | |
|---|---|---|---|---|
| 1,347,642 | * | 7/1920 | McNatt | 5/502 |
| 2,064,458 | * | 12/1936 | Bulpit et al. | 5/413 R |
| 2,757,390 | * | 8/1956 | Miller | 5/413 R |
| 2,783,473 | * | 3/1957 | Humpeler | 5/417 X |
| 2,870,464 | * | 1/1959 | Lalick | 5/502 |
| 3,083,430 | * | 4/1963 | Shears | 24/662 |
| 3,175,231 | * | 3/1965 | Magario et al. | 5/413 R |
| 3,477,552 | * | 11/1969 | Goldman | 5/417 |
| 3,508,285 | | 4/1970 | Marquette . | |
| 3,530,516 | | 9/1970 | Marquette . | |

(List continued on next page.)

OTHER PUBLICATIONS

Doctor Down Rescue Wrap brochure, Box 1, Polson, MT 59860 U.S.A.

*Primary Examiner*—Terry Lee Melius
*Assistant Examiner*—Robert G. Santos
(74) *Attorney, Agent, or Firm*—Timothy J. Martin; Michael R. Henson; Mark H. Weygandt

(57) ABSTRACT

An emergency care blanket may be assembled into a plurality of desired arrangements to protect an individual from prevailing environmental conditions while providing access to the patients. Broadly the blanket includes a first flexible covering, a second flexible covering and a plurality of fasteners associated with the first and second coverings. Each of the fasteners includes two fastening structures, preferably male and female snaps, which project from opposite respective ones of the upper and lower surfaces of their associated first and second coverings. Thus, cooperative fastening structures can matably engage so that the first and second coverings may be releasably secured thereby to assemble the emergency care blanket into a fastened state characterized by one of the plurality of desired arrangements. A plurality of similarly configured first and second flexible coverings may also be provided to define a modular emergency care blanket system, whereby layers of covering may be added or removed to accommodate the individual.

14 Claims, 7 Drawing Sheets

U.S. PATENT DOCUMENTS

| | | | | |
|---|---|---|---|---|
| 4,090,269 | * | 5/1978 | Hunt | 5/413 R |
| 4,261,058 | * | 4/1981 | Buchman | 5/417 |
| 4,324,012 | * | 4/1982 | Cannaday | 5/656 |
| 4,484,362 | * | 11/1984 | Asher | 2/69 |
| 4,513,461 | * | 4/1985 | Tardivel | 5/413 R |
| 4,573,227 | * | 3/1986 | Prandina | 5/502 |
| 4,573,516 | | 3/1986 | Prandina . | |
| 4,579,753 | | 4/1986 | Gjendemsjo . | |
| 4,590,714 | * | 5/1986 | Walker | 5/417 |
| 4,624,320 | * | 11/1986 | Romaine | 169/50 |
| 4,631,765 | | 12/1986 | Casey . | |
| 4,671,049 | | 6/1987 | Benckhuijsen . | |
| 4,688,282 | | 8/1987 | Jeffries . | |
| 4,752,971 | | 6/1988 | Meserol . | |
| 4,757,832 | * | 7/1988 | Russell | 5/413 R |
| 4,839,934 | | 6/1989 | Rojas . | |
| 4,872,220 | * | 10/1989 | Haruvy et al. | 2/243 A |
| 4,884,303 | * | 12/1989 | Scherer | 5/413 R |
| 4,887,317 | | 12/1989 | Phillips, Sr. et al. . | |
| 4,894,878 | * | 1/1990 | Roach | 2/69.5 |
| 4,910,055 | * | 3/1990 | Wigutow | 5/413 R X |
| 4,979,251 | | 12/1990 | Lazar . | |
| 4,989,282 | * | 2/1991 | Goldstein | 5/413 R |
| 5,005,235 | * | 4/1991 | Huang | 5/413 R |
| 5,010,610 | * | 4/1991 | Ackley | 5/420 |
| 5,099,531 | | 3/1992 | Schmier . | |
| 5,217,034 | * | 6/1993 | Yih et al. | 5/420 |
| 5,257,427 | * | 11/1993 | Hinshaw | 5/420 |
| 5,457,829 | * | 10/1995 | Elliott | 5/420 |
| 5,463,783 | * | 11/1995 | Pope | 5/417 |
| 5,533,216 | * | 7/1996 | Thier | 5/413 R |
| 5,592,691 | * | 1/1997 | Ronald | 2/69 |
| 5,713,089 | * | 2/1998 | Ferrante | 5/502 |
| 5,722,130 | * | 3/1998 | Baader | 24/662 |
| 5,730,529 | * | 3/1998 | Fritz et al. | 5/417 X |
| 5,732,424 | * | 3/1998 | Bond | 5/502 |
| 5,798,166 | * | 8/1998 | Gross | 5/413 R X |
| 5,850,643 | * | 12/1998 | Brumfield | 5/419 |
| 5,855,032 | * | 1/1999 | Field | 5/502 |
| 5,887,299 | * | 3/1999 | Phillips | 5/413 R |
| 5,924,132 | * | 7/1999 | Wigutow | 2/69 |
| 5,970,541 | * | 10/1999 | Chiang | 5/420 |

* cited by examiner

EMERGENCY CARE BLANKET

FIELD OF INVENTION

The present invention generally relates to a protective apparatus for use in emergency care situations. The present invention more particularly relates to protective blankets that may be used in providing an insulated weather resistant covering for an individual in need of assistance. Even more specifically, the present invention concerns emergency care blankets which are adapted to be selectively assembled into a plurality of desired arrangements to accommodate a patient in need of assistance and to protect the patient against prevailing environmental conditions.

BACKGROUND OF THE INVENTION

In many emergency situations, it is critical for a patient to receive prompt and proper attention to his/her injuries in order to avoid exacerbating injuries which have already occurred. Often, the first rescuers to arrive on the scene are emergency medical staff who are responsible for preparing the patient for transportation to the nearest medical facility where the individual's injuries can be treated. Depending upon the particular circumstances surrounding the patient's injuries and the location of an accident scene, these rescuers are typically emergency medical squads who are employed with either a fire department, a local hospital, a law enforcement agency, rescue patrols and the like. In most situations, the patient is transported to the most appropriate medical facility by a ground ambulance, but air ambulances are also employed when circumstances dictate that this would be most efficient.

One of the many concerns of certified rescue workers during their preliminary treatment of a patient is to provide, to the extent possible, the most comfortable surroundings for the individual. This can both place the patient at ease and can be vital to the success or failure of initial medical treatment, particularly in instances where weather conditions are severe or where the patient is in shock. For instance, rescues which take place in cold or wet weather conditions, such as those often encountered by ski patrols, require that the patient be adequately insulated from the cold to avoid further reduction in body temperature, while rescues occurring in windy or rainy climates require that the patient be covered with a material which is repellant to these elements. Therefore, it is vital that the emergency rescue personnel be adequately equipped so that they can quickly and properly adapt to the specific situation at hand.

In the past, it was not uncommon for patients to be strapped onto a gurney and provided with little more than a protective pad or ordinary blanket coverings during transportation to a medical facility. Not surprisingly, such accommodations did little to help improve the patient's condition. Moreover, such an approach was cumbersome and did little to provide adequate protection from the elements. Accordingly, efforts were made by manufacturers to provide a more compact and durable protective blanket which was able to provide all-season comfort and protection to a patient. Products which exist today are typically in the form of insulated sleeping bags which are designed to stabilize the patient's body temperature.

While these techniques are adequate for adapting to some of the situations which may arise during the preliminary stages of a rescue, they are limited in their application. Most notably, these approaches are limited in their versatility because it is cumbersome for the rescue workers to efficiently arrange the bedding systems to provide a stable environment for the patient in all types of prevailing environmental conditions.

For example, when conditions are extremely cold these bedding systems, in and of themselves, would likely not provide sufficient insulation to the patient. The potentially disastrous consequence could be a drop in body temperature resulting in a complication to existing injuries or an otherwise avoidable fatality. At the other extreme, these bedding systems may function to retain too much heat around the body which can also jeopardize the success of the rescue attempt. In order to circumvent these problems, the rescue workers would be required to either add additional layers of insulation over the existing sleeping bag arrangement to stabilize the patient's body temperature or manipulate the fastening assembly on the sleeping bag to allow for more circulation into the interior. It is also not uncommon for rescue personnel to join the patient in the sleeping bag in an effort to better regulate body temperature. If these options cannot be performed in an efficient manner, the health and welfare of the patient is at risk.

A further disadvantage of these approaches is that it is difficult to safely transport the patient, when in the sleeping bag, from one location to another without the need for additional equipment. Accordingly, there remains a need for an improved emergency care blanket which is adapted to adequately protect the patient during a variety of prevailing environmental conditions. There is a further need to provide such an emergency care blanket which allows for easy accessibility to the patient during rescue and which is simplified in construction so as not to interfere with rescue efforts.

SUMMARY OF INVENTION

It is an object of the present invention to provide a new and useful emergency care blanket which may be selectively assembled into a variety of desired arrangements to accommodate an individual in need of assistance.

Another object of the present invention is to provide an emergency care blanket which is adapted to protect an individual against prevailing environmental conditions.

A further object of the present invention is to provide an emergency care blanket which is foldable into a compact state to allow for easy transportation thereof when not in use.

A still further object of the present invention is to provide an emergency care blanket which allows for easy accessibility to a patient during a rescue attempt.

It is another object of the present invention to provide an emergency care blanket which is sized sufficiently to allow a rescue worker to join a patient within the blanket in an effort to better regulate the patient's body temperature.

Yet another object of the present invention is to provide a modular emergency care blanket system which can be selectively assembled into a plurality of desired configurations to accommodate an individual in need of assistance and to protect the individual against prevailing environment conditions.

According to the present invention, then, an emergency care blanket is provided which is adapted to be selectively assembled into a plurality of desired arrangements to accommodate an individual in need of assistance and to protect the individual from heat loss and against prevailing environmental conditions. Broadly, the emergency care blanket according to the present invention comprises first and second flexible coverings of a selected geometric shape, preferably rectangular, and a plurality of fasteners. The first flexible covering has an upper first covering surface and a lower first covering surface, and the second flexible covering likewise has an upper second covering surface and a lower second surface. Either one of the first and second flexible coverings is fabricated from a thermally insulating, heat reflective material which includes a weather resistant, yet breathable, shell layer affixed to the thermally insulating material such that a dead air space is thereby formed to trap air therebetween and provide added insulation to the emergency care blanket. Another of the first and second flexible coverings is fabricated from a weather resistant material which is preferably also fire resistant.

Each of the plurality of fasteners includes two fastening structures with each of these fastening structures projecting from opposite respective ones of the upper surface and lower surface of its associated one of the first and second flexible coverings. As such, selected ones of the fastening structures are operative to matably engage selected other ones of the fastening structure so that the first and second flexible coverings may be releasably secured, thereby to assemble the emergency care blanket into a fastened state characterized by one of the plurality of desired arrangements. First ones of the plurality of fasteners are disposed on the first flexible covering and second ones of the plurality of fasteners are disposed on the second flexible covering. Each of these fasteners includes a first fastening structure of a first type, such as a male snap fastener, and a second fastening structure of a second type, such as a female snap fastener, that is matable with the first type to allow for releasable securement of the first and second flexible coverings. The fasteners are positioned at discrete locations along opposite longitudinally extending side edges of the first flexible covering and the second flexible covering, respectively, to allow selected ones of the first and second fastening structures to be disengaged from one another to form regions of access to the interior of the emergency care blanket. It is preferred that a strip of backing material be interposed between each male fastener and its associated female fastener to securely retain the fasteners onto their respective flexible coverings.

The first flexible covering is foldable and/or rollable into a storable state and the second flexible covering is also foldable and/or rollable into a storable state. A pocket is disposed on the upper first covering surface which is sized to receive the second flexible covering when the second flexible covering is in the folded state. This pocket is formed from a transparent material, such as a meshing and has a margin thereof which is operative to releasably engage the first upper surface to define a mouth through which the second flexible covering may be received. A pair of continuous loop elastic members are secured to the first upper surface and are each adapted to surround the first flexible covering to retain the covering in the storable state.

The first and second flexible coverings may be releasably connected together in a face-to-face relationship along their respective edge margins and litter handles may be provided on either or both of these flexible coverings to facilitate lifting and transportation of the individual. These litter handles are positioned at spaced apart locations on the upper surface of their respective coverings and are interconnected by parallel strap portions secured along the upper surface.

The first and second flexible coverings may also each be provided with a draw cord which extends along their transversely extending end edges. It is preferred that the drawcord associated with a first flexible covering be positioned an inset distance from its transversely extending end edges, while the draw cord associated with the second flexible covering be positioned along the transversely extending end edges. This allows these draw cords, when manipulated, to provide at least two separate seal regions to better protect the individual against the prevailing environmental conditions.

A hood is provided which is releasably attachable to the first flexible covering, and this hood includes at least one hood fastener which a readapted to releasably engage a cooperative fastener disposed along a transversely extending end edge of the first flexible covering. This hood may be fabricated from a thermally insulating material, as with the first flexible covering, and a weather resistant, yet breathable, shell layer may be affixed to this thermally insulating material.

According to the present invention, a modular emergency care blanket system is also provided which is adapted to be selectively assembled into any one of a plurality of desired configurations which consist of, but are not limited to: stacked, edge-to-edge, confronting, co-extensive and contiguous. This modular emergency blanket system comprises a plurality of first flexible coverings, second flexible coverings and fasteners as described above.

These and other objects of the present invention will become more readily appreciated and understood from a consideration of the following detailed description of the exemplary embodiment of the present invention when taken together with the accompanying drawings, in which:

BRIEF DESCRIPTION OF DRAWINGS

FIG. 12(*b*) is an enlarged end view of the second exemplary embodiment of the present invention shown in the emergency care blanket secured in a second fastened arrangement;

FIG. 12(*c*) is an enlarged end view of the second exemplary embodiment of the present invention shown in the emergency care blanket secured in a third fastened arrangement;

DETAILED DESCRIPTION OF THE EXEMPLARY EMBODIMENT

The present invention relates to an emergency care blanket which is especially adapted to protect an individual in need of assistance against inclimate weather and/or to protect a patient against shock hypothermia. The emergency care blanket is adapted to be selectively assembled into a variety of arrangements or configurations to provide both comfort and protection to a patient during a rescue effort. It should be readily appreciated based on the discussion to follow with reference to the exemplary embodiment of the present invention that the emergency care blanket and the modular emergency care blanket system according to the present invention are uniquely designed to be manipulated in a timely manner to adapt to the circumstances surrounding the particular medical emergency at hand.

Figure 1:
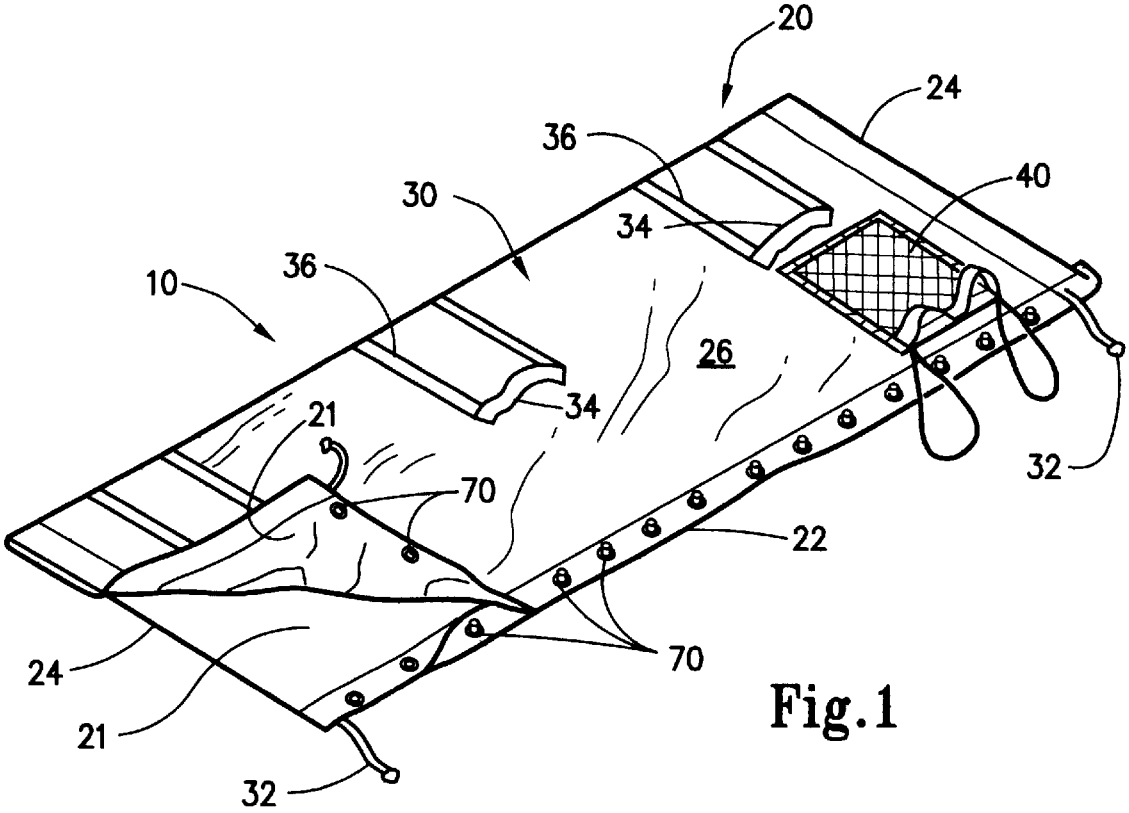
FIG. 1 is a perspective view of a first flexible covering according to an exemplary embodiment of the present invention, as shown in a folded condition.
Figure 2:
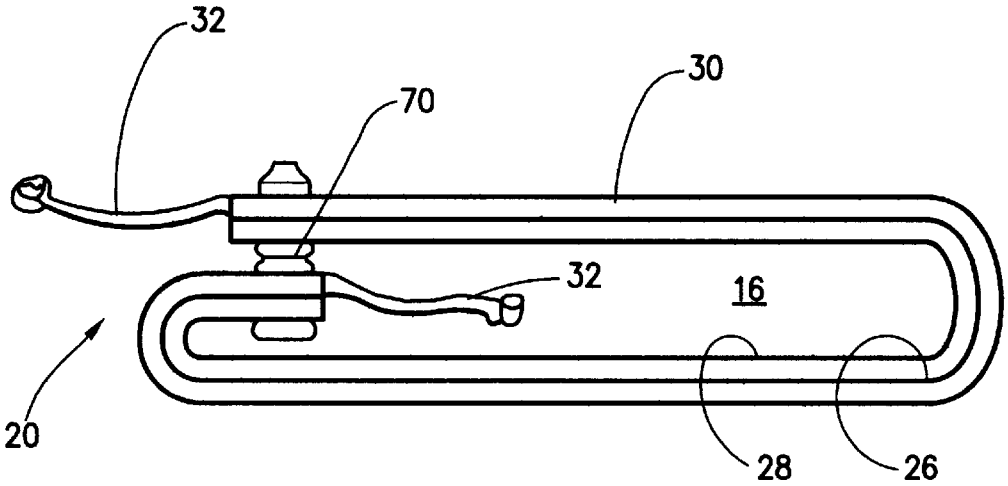
FIG. 2 is an enlarged end view of the first flexible covering of FIG. 1.
Figure 3:
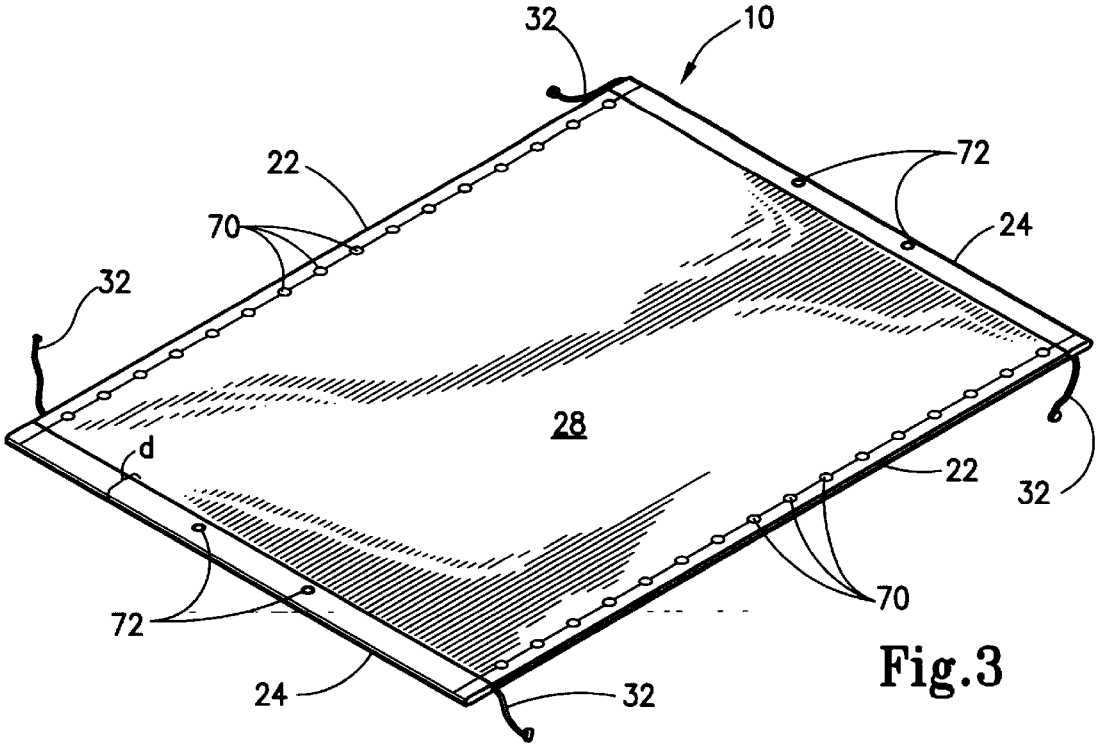
FIG. 3 is a perspective view of the lower first covering surface of the first flexible covering of FIG. 1.

In its broadest form, the emergency care blanket 10 of the present invention comprises first and second flexible coverings of a selected geometric shape and a plurality of fasteners associated with each of these coverings so that the first and second coverings may be releasably secured together in a fastened state characterized by any of a plurality of desired arrangements. The first flexible covering 20, as generally introduced in FIGS. 1 through 3, is formed as a rectangular member having opposite longitudinally extending side edges 22 and transversely extending end edges 24. The first covering 20 is a flexible member so that it may be folded over onto itself, as shown in FIG. 1, to form a sleeping bag type arrangement wherein the longitudinally extending side edges 22 are positioned in an overlapping manner adjacent one another. First flexible covering 20 is a thermally insulating covering formed by an insulating layer 21 and a shell layer 30 which are secured together in a confronting relationship to define an upper first covering surface 26 and a lower first covering surface 28. The thermally insulating covering is fabricated from a thermal material to provide more warmth for its weight than ordinary blankets. This thermal material is preferably a fleece lining which absorbs less than one percent (1%) of its weight in moisture and which retains its insulating ability in damp or wet conditions.

A plurality of fasteners 70 are positioned along the longitudinally extending side edges 22 of both the upper first covering surface 26 and the lower first covering surface 28. These fasteners 70 are shown here as snaps positioned at selected discrete locations along the longitudinal edges 22 of the first flexible covering 20, but it should be appreciated that other types of fastening structures, such as Velcro®, may be employed for at least some of the configurations of the present invention discussed herein.

In addition to fasteners 70, transversely spaced pairs of fasteners 72 are also positioned medially along the transversely extending end edges 24 of the first flexible covering 20. The preferred structure employed for fasteners 70 and 72 will be discussed in more detail below with reference to FIG. 6, but it should be mentioned here that each of fasteners 70 are adapted to releasably and matably engage one another so that the first flexible covering 20 may be folded over onto itself and secured along the longitudinally extending side edges 22.

Shell layer 30 is a weather resistant, yet breathable, layer which is affixed to the thermally insulating covering along the upper first surface 26 such that a dead air space is formed. This allows air to be trapped between the shell layer 30 and the thermally insulating covering to provide added insulation to the emergency care blanket 10. It should be readily appreciated by one of ordinary skill in the art that by trapping air between the shell layer 30 and the thermally insulating covering, better insulation can be achieved than by not providing this trapped air between the layers.

As also illustrated in FIGS. 1 and 2, the first flexible covering 20 is provided with a first pair of draw cords 32 which extend transversely across the covering proximate to its transversely extending end edges 24. When manipulated, this first pair of draw cords 32 allows for two circuitous seal regions around both the foot region of the patient's body and the head region of the patient's body. These draw cords 32 are specifically positioned an inset distance "d" of about two to three inches from the transversely extending end edges 24, and the advantage of this feature will be described in greater detail below with reference to FIG. 8.

Figure 4:
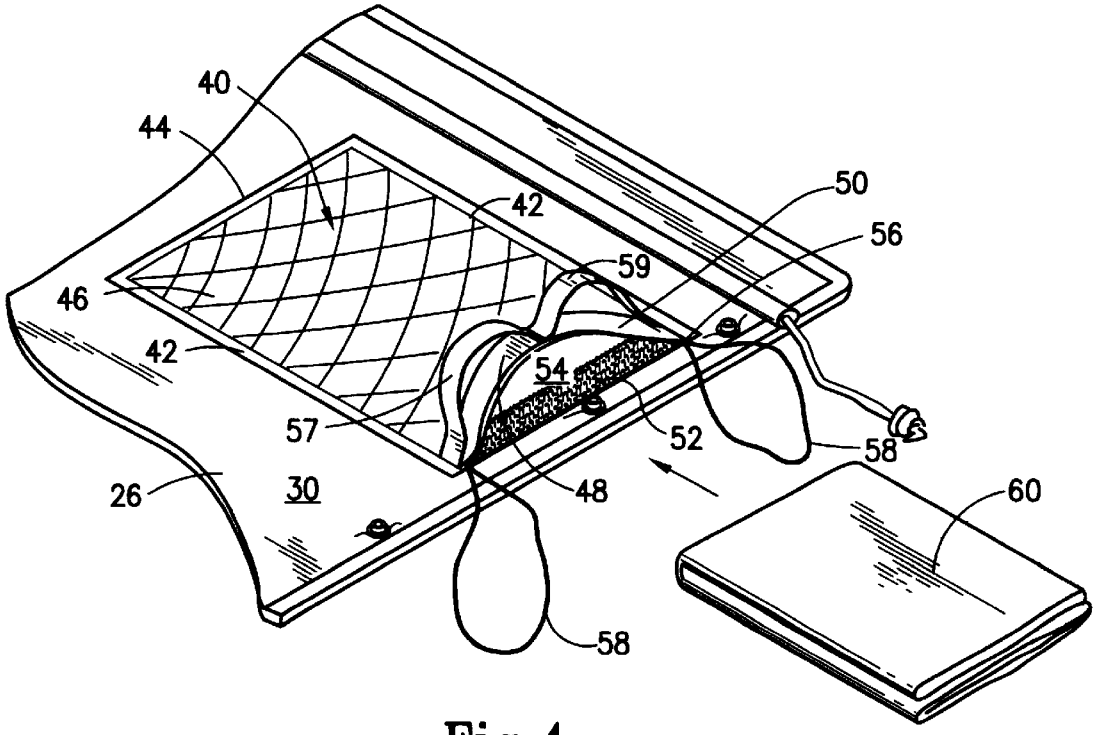
FIG. 4 is an enlarged perspective view of the first flexible covering, partially broken away, and showing a utility pocket secured thereto which is sized to receive a second flexible covering which is in a folded state.
Figure 10:
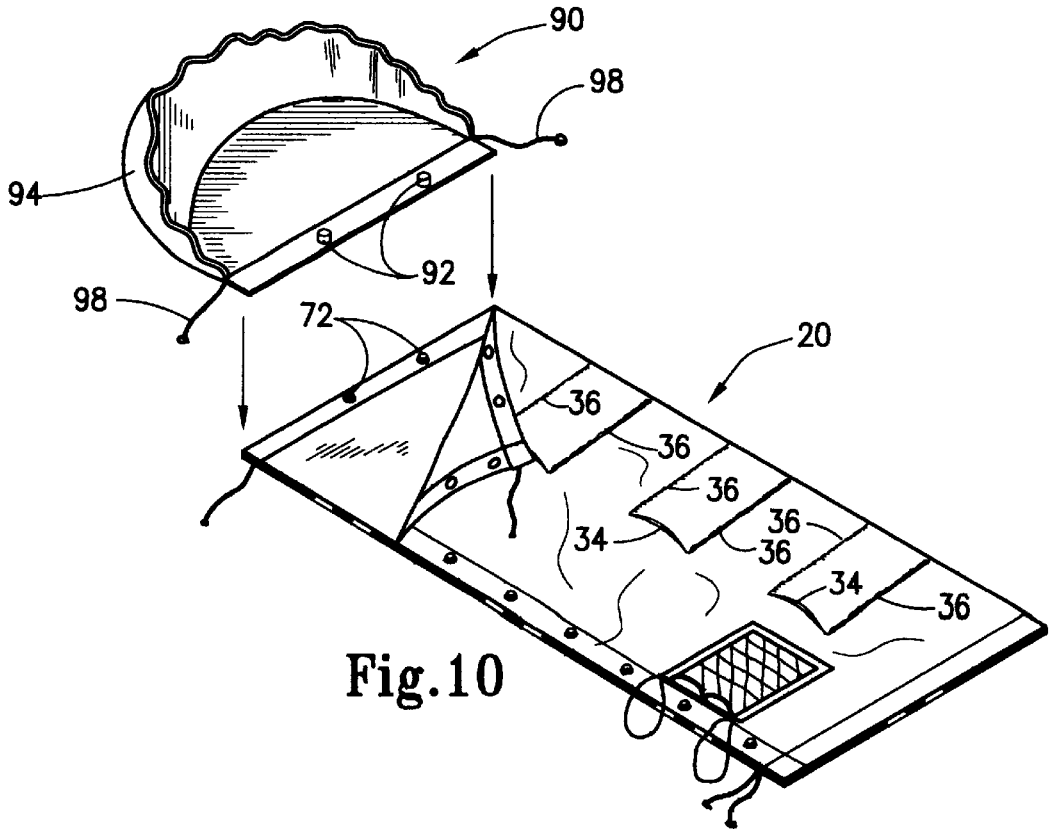
FIG. 10 is an exploded perspective view showing the attachment of a hood to the first flexible covering depicted in FIG. 1.

Another feature of first covering 20 is a utility pocket 40 provided on the upper first surface 26 of the first flexible covering 20 proximate a juncture location of one of the longitudinally extending side edges 22 and the transversely side edges 24. This utility pocket, as best shown in FIG. 4, is equipped to receive both a variety of medical accessories, such as a stethoscope, gauze a detachable hood or the like, as well as a second flexible covering 60 when the second flexible covering 60 is in a folded state. Utility pocket 40 is preferably secured to shell layer 30 along opposed transverse seam lines 42 and longitudinal seam line 44. The utility pocket 40 is formed from a transparent material, such as meshing 46 which has a longitudinal margin 48 thereof releasably securable to shell layer 30 and upper first surface 26 by cooperative Velcro® fasteners 50 and 52, thereby to define a mouth 54 through which the second flexible covering 60 may be received. As best shown in FIGS. 1 and 10, flexible covering 20 is also provided with litter handles 34 to facilitate lifting and transportation of the individual. These litter handles 34 are positioned at spaced apart locations on the upper first surface 26 and are interconnected by parallel strap portions 36 secured along upper first surface 26. Strap portions 36 provide additional under body support to the patient during transforation.

Figure 5:
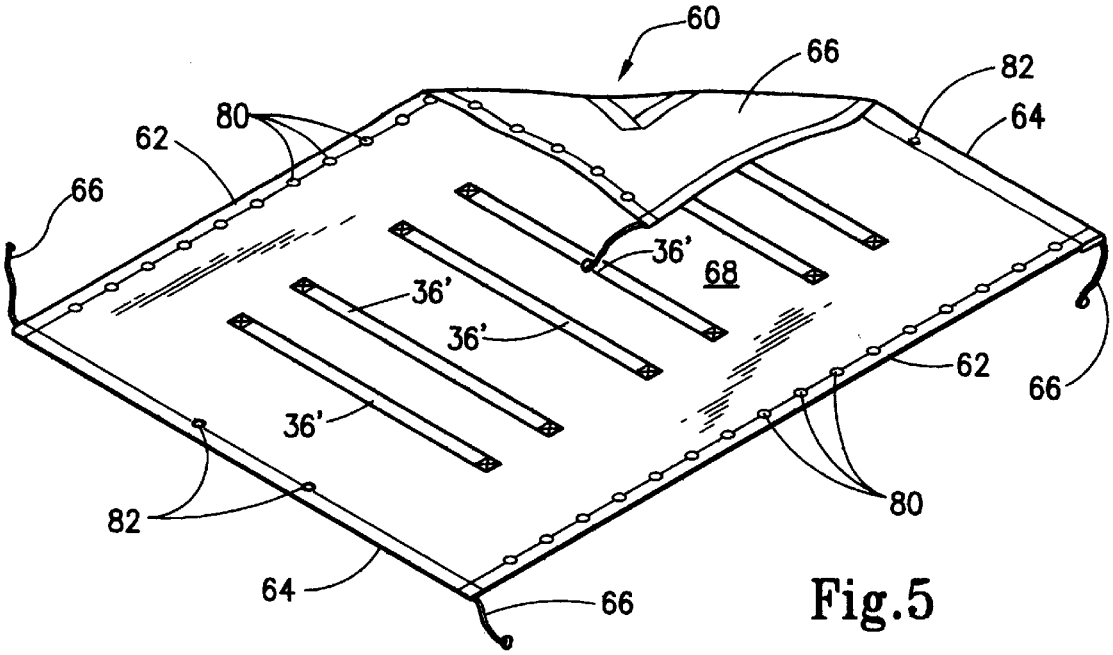
FIG. 5 is a perspective view of a second flexible covering according to an exemplary embodiment of the present invention.

The second flexible covering 60 which comprises a component of emergency care blanket 10 is shown in FIG. 5 to be configured in a selected geometric shape similarly to and preferably substantially congruent with first flexible covering 20. Thus, second flexible covering 60 is a generally rectangular member having opposite pairs of longitudinally extending side edges 62 and transversely extending end edges 64. Second flexible covering 60 is a lightweight, fully waterproof and windproof storm cover which provides protection in extreme conditions. Preferably, this second flexible covering 60 is also fire resistant. As with first flexible covering 20, a plurality of fasteners 80 and 82 are respectively positioned at discrete locations along the longitudinally extending side edges 62 and the transversely extending end edges 64 of second flexible covering 60. Fasteners 80 and 82 are of identical structure. These fasteners 80 and 82 are also especially designed so that selected ones are operative to matably engage one another so that second flexible covering 60 may be secured in a folded state. Moreover, fasteners 80 are operative to matably engage fasteners 70 associated with first flexible covering 20 so that the first and second flexible coverings 20, 60 may be releasably secured together, thereby to assemble the emergency care blanket 10 into a fastened state characterized by any one of a plurality of desired arrangements. Second flexible covering 60 also includes parallel strap portions 36' secured along surface 68.

Figure 6:
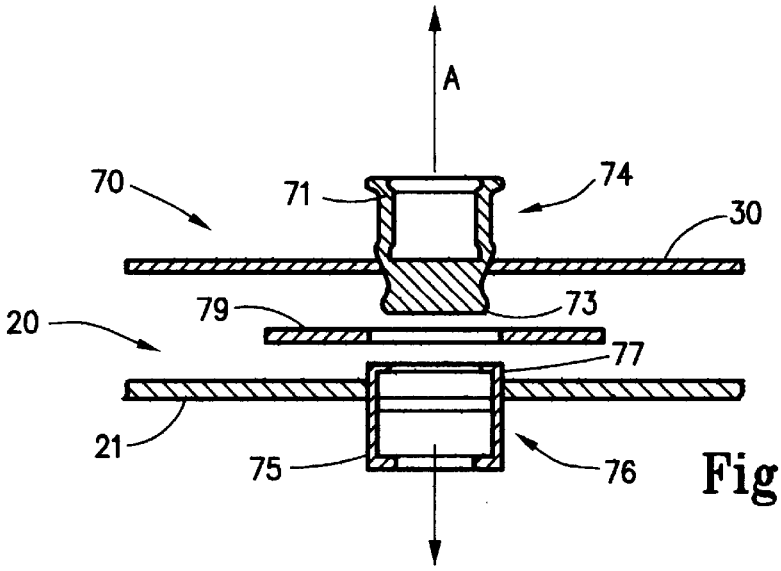
FIG. 6 is an exploded cross-sectional view of the assembly of a selected one of the plurality of fasteners according to the present invention.

In FIG. 6, a preferred construction is shown for a representative one of the first ones of the plurality of fasteners 70 secured to first flexible covering 20. Of course, it should be understood that while FIG. 6 only depicts fastener 70, it is also representative of the construction of the other fasteners discussed above in reference to the present invention. Thus, the transversely spaced pair of fasteners 72 on first flexible covering 20 and the fasteners 80 and 82 associated with second flexible covering 60 are constructed similarly.

Fastener 70, then, includes a first fastening structure 74 of a first type which is shown here as a male snap fastener, and a second fastening structure 76 of a second type which is shown here as a female snap fastener that is matable with first fastening structure 74. First and second fastening structures 74 and 76 are axially aligned with each other along an axis "A" which passes through first flexible covering 20. First fastening structure 74 includes a head portion 71 which projects away from shell layer 30 and a rivet 73 which penetrates both shell layer 30 and the thermally insulating material. Second fastening structure 76 includes a head portion 75 which projects away from the lower first surface 28 of first flexible covering 20 and a foot portion 77 which pass through lower first surface 28. Rivet 73 and foot portion 77 are secured to one another at a juncture location within first flexible covering 20. As also shown in FIG. 6, a strip of backing material 79 is interposed between first fastening structure 74 and second fastening structure 76 at this juncture location. Backing material 79 provides added reinforcement to fastener 70 to securely retain fastener 70 onto first flexible covering 20 and reduce the likelihood of fastener 70 from tearing away from covering 20.

Figure 7:
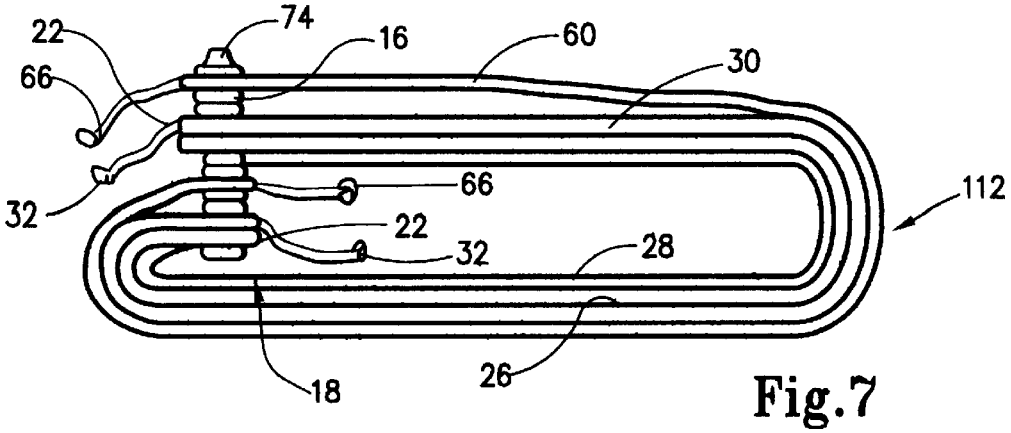
FIG. 7 is an enlarged end view of a desirable fastened state for the first and second flexible coverings according to the present invention.

With this fastener arrangement in mind, the versatility of emergency care blanket 10 may be better appreciated. One desirable arrangement for releasably securing first and second flexible coverings 20 and 60 together is shown in FIG. 7 wherein the first and second flexible coverings 20 and 60 are shown secured together in a fastened state to form a composite, multi-layer emergency blanket which is then folded over about its middle 12 so that longitudinally extending side edges 22 are located adjacent one another. In this arrangement, each first fastener 74 of a first type is matably engaged with a cooperative second fastener 76 of a second type. This particular arrangement for the emergency care blanket is beneficial because it provides both insulation to the patient and projects the patient from the elements by virtue of the repellant second flexible covering 60. Moreover, it should now be appreciated that additional layers of either the first flexible covering 20 or the second flexible covering 60 may be readily added to emergency care blanket 10 as needed.

As also shown in FIG. 7, a removable liner 18 may be inserted within the interior of the emergency care blanket to keep the blanket clean and sanitized between uses. Removable liner 18 may be provided with snap fasteners (now shown), as discussed above, to secure it within the interior. Other types of fastening structures, such as Velcro® strips, may also be used to releasably attach removable liner 18 to first flexible covering 20. It should be noted, though, that the emergency care blanket of FIG. 1 could also be encased in a sufficiently sized pillow case structure to provide a clean environment between uses.

Figure 8:
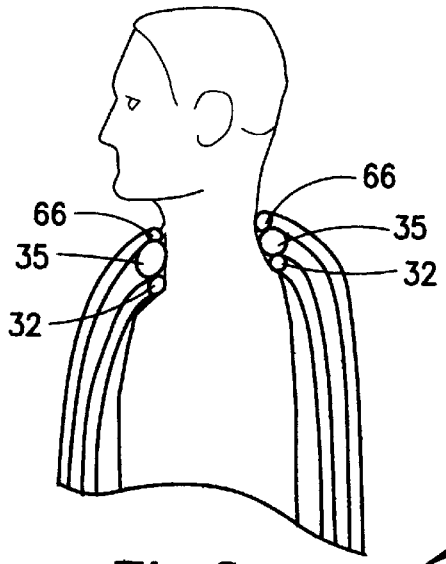
FIG. 8 is a side view in partial cross-section showing the locations of two separate seal regions around a patient's neck when the draw cords of the first and second flexible coverings of FIG. 7 are manipulated.

With the embodiment of FIG. 7 in mind, then, the advantage of incorporating the first pair of draw cords 32 at an inset distance from the transversely extending end edges 24 of first flexible covering 20 and incorporating the second pair of draw cords 66 proximate to the transversely extending end edges 64 of second flexible covering 60 may be better appreciated. FIG. 8 shows that these locations provide at least two separate seal regions around the patient's body to define a collar 35 therebetween. This is beneficial because it provides a double seal to prevent additional air from penetrating into an interior of the emergency care blanket 10. It also provides, since either blanket end may be sealed, that the patient's head or feet may be at either end.

Figure 9:
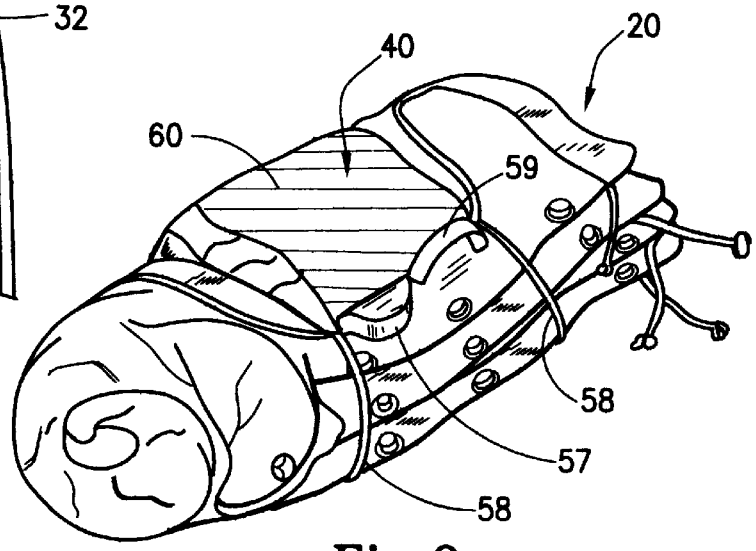
FIG. 9 is a perspective view showing the first flexible covering secured in a storable state.

A useful feature of the emergency care blanket according to the present invention is shown in FIG. 9 wherein it may be seen that first flexible covering 20 may be folded up or rolled up into a storable state, with second flexible covering 60 received within utility pocket 40 when second flexible covering 60 is in a folded state. Continuous loop elastic strap members 58 may be then looped around first flexible covering 20 to retain first flexible covering 20 in the rolled up or storable state. This compact unit may then be easily transported by carrying straps 57 and 59.

As shown in FIG. 10, the emergency care blanket according to the present invention may also include a hood 90 which is releasably attachable to the first flexible covering 20. Here, hood 90 is provided with a pair of transversely spaced fasteners 92 which are identical in structure to the plurality of fasteners discussed above with reference to the first and second flexible coverings 20 and 60. These transversely spaced fasteners 92 are, thus, adapted to releasably and matably engage the pair of fasteners 72 positioned along either of the transversely side edges 24 of first flexible covering 20.

Preferably, hood 90, like first flexible covering 20, is formed from a thermally insulating material which accommodates a wide range of temperature conditions and includes an outer hood shell 94 secured thereto which is fabricated from the same material as shell layer 30 discussed above. Of course, because transversely spaced fasteners 92 are identical in construction to the fasteners discussed above with reference to the first and second flexible coverings 20 and 60, it should be readily appreciated by one of ordinary skill that hood 90 is also adapted to releasably and matably engage the fasteners 82 positioned medially along the transversely extending end edges 64 of second flexible covering 60. As also shown in FIG. 10, hood 90 may be provided with hood draw cords 98 to provide a more secure covering arrangement around the head of a patient.

Figure 11:
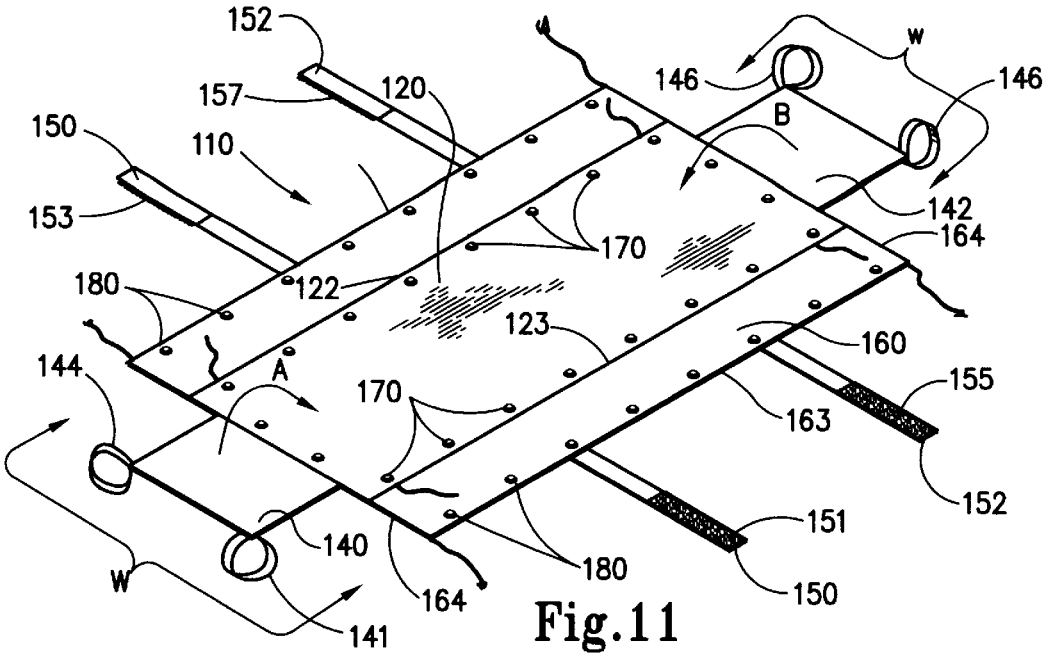
FIG. 11 is a perspective view of a second exemplary embodiment of the present invention.
Figure 12A:
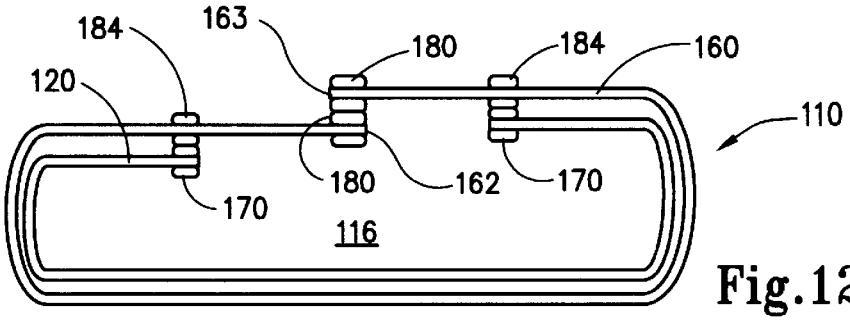
FIG. 12(*a*) is an enlarged end view of the second exemplary embodiment of the present invention showing the emergency care blanket secured in a first fastened arrangement.
Figure 12B:
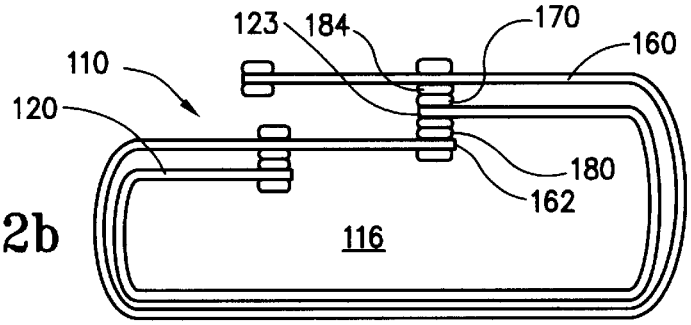
Figure 12C:
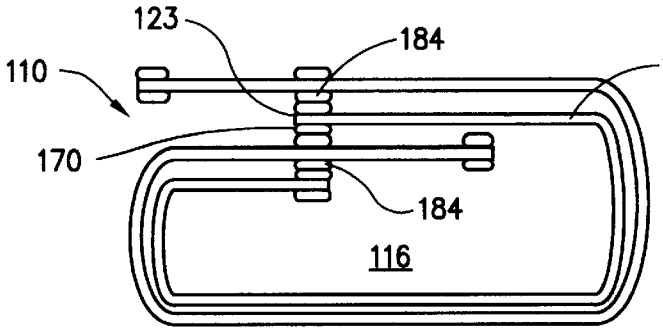

A second exemplary embodiment of the present invention is shown in FIGS. 11 and 12(*a*)–12(*c*). Emergency care blanket 110 comprises a first flexible covering 120, a second flexible covering 160 and a plurality of fasteners. Fasteners 170 are disposed on first flexible covering 120 and fasteners 180 are disposed on second flexible covering 160. First flexible covering 120 and fasteners 170, 180 are constructed the same as described above with reference to the first exemplary embodiment of the invention.

Here, however, second flexible covering 160 is formed as an enlarged, generally rectangular panel member having a transverse "W" that is greater than the transverse width "w" of first flexible covering 120. First flexible covering 120 is releasably securable to second flexible covering 160 by engaging fasteners 170 with cooperative fasteners 184, as best shown in FIGS. 12(*a*)–12(*c*), which are positioned at discrete locations along second flexible covering 160. It should be understood, of course, that fasteners 184 need to be positioned at locations along second flexible covering 160 which correspond to the positioning of fasteners 170 on first flexible covering 120 so that the two coverings 120 and 160 may be properly secured together in a face-to-face relationship.

Before discussing the advantage of incorporating an enlarged second flexible covering 160 into emergency care blanket 110, it may also be seen in FIG. 11 that opposed head and foot extensions, 140 and 142 respectively, are formed along the transversely extending ends 164 of second flexible covering 160. These extensions 140 and 142 are fabricated from the same material as second flexible covering 160 and are, thus, adapted to fold over, in the directions of arrows "A" and "B" respectively, to provide an additional covering to a patient's extremities, preferably the patient's feet, prior to folding emergency care blanket 110.

Alternatively, head and foot extensions 140 and 142 may be folded in the directions of arrows "A" and "B", respectively, after emergency care blanket 110 has been folded. Strap loops 144 and 146 are secured, respectively, to corners of head and foot extensions 140, 142 and securement straps 150 and 152 may be passed through these strap loops 144 and 146 after folding emergency care blanket 110 so that the individual is securely enclosed therein during transportation. Specifically, securement strap 150, which has cooperative Velcro® strips 151 and 153, is operative to pass through strap loops 144, while securement strap 152, which is provided with cooperative Velcro® strips 155 and 157, is operative to pass through strap loops 146. It should be appreciated, though, that a variety of different constructions for securement straps 150 and 152 are contemplated. Thus, for example, straps 150 and 152 could be durable members, with buckles, or other equivalent structures, substituted for Velcro® strips 153 and 157 to allow for better securement around the individual.

With an understanding of the construction of emergency care blanket 110, it can now be seen in FIGS. 12(*a*)–12(*c*) that three distinct fastened states may be realized. Emergency care blanket 110 has a different size interior in each of these fastened arrangements so that it may be better adapted to accommodate individuals of different sizes. In FIG. 12(*a*), emergency care blanket 110 is shown in a first fastened arrangement so that its interior 116 is at a maximum. In this state, each of fasteners 180 disposed along a first longitudinally extending side edge 162 of second flexible covering is secured to a cooperative fastener 180 disposed along a second longitudinally extending side edge 163 of second flexible covering 160. In FIG. 12(*b*), emergency care blanket 110 is shown fastened in a second arrangement to have an interior 116 which is smaller than that represented in FIG. 12(*a*). In this second arrangement, each of fasteners 170 disposed along a second longitudinally extending side edge 123 of first flexible covering 120 is securely interposed between a cooperative fastener 184 of second flexible covering 160 and a cooperative fastener 180 disposed along the first longitudinally extending side edge 162 of second flexible covering 160. Finally, emergency care blanket 110 is shown in FIG. 12(*c*) to be in a third fastened arrangement. Here, interior 116 is at a minimum relative to the first and second fastened arrangements discussed above. In this third fastened arrangement, each of fasteners 170 disposed along second longitudinally extending side edge 123 of first flexible covering 120 is interposed between two cooperative fasteners 184 disposed on opposite sides of second flexible covering 160.

Figure 13A:
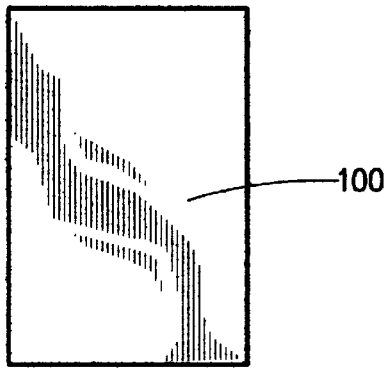
FIGS. 13(*a*) and 13(*b*) illustrate two possible arrangement for either one of the first and second flexible coverings according to the present invention.
Figure 13B:
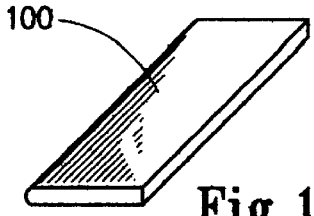
Figure 14A:
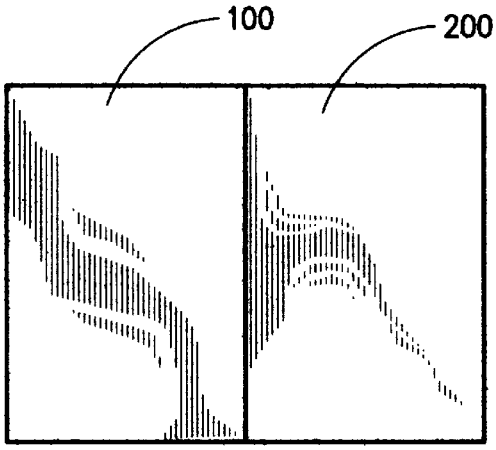
FIGS. 14(*a*)–14(*d*) illustrate four possible connected arrangements for the flexible coverings according to the present invention.
Figure 14B:
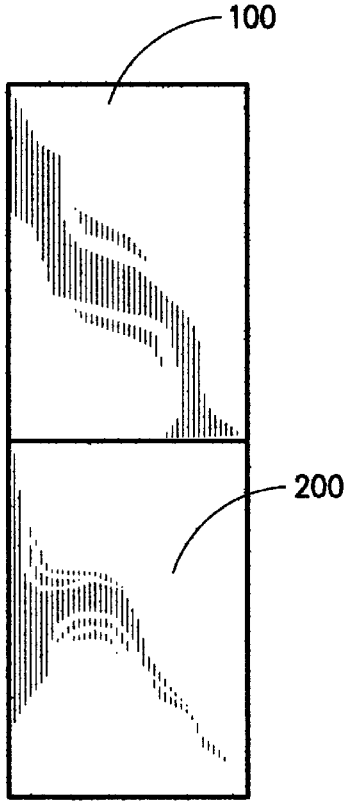
Figure 14C:
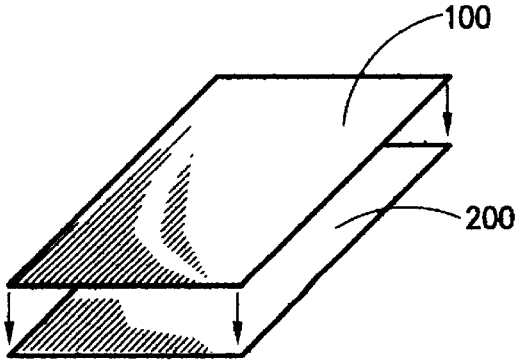
Figure 14D:
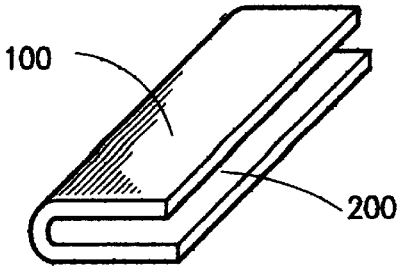

By way of example only, FIGS. 13 and 14 illustrate a variety of possible arrangements which the emergency care blanket of the present invention may assume. In each of these figures, the flexible covering(s) depicted may be either a first flexible covering(s) as described above with reference to the FIGS. 1–3 or a second flexible covering(s) as discussed with reference to FIG. 5, or any combination of the two. Accordingly, reference will only be made here to a flexible covering, without limitation of the particular type. In FIGS. 13(*a*) and 13(*b*) a flexible covering 100 is shown in an unfolded state and a folded state respectively. This provides a single layer sleeping bag-type arrangement for an individual in need of assistance. FIGS. 14(*a*)–14(*d*) show some possible connected arrangements for two coverings 100 and 200. In FIG. 14(*a*) coverings 100 and 200 are secured together along respective ones of their longitudinally extending side edges to form a double width emergency care blanket. In FIG. 14(*b*) flexible coverings 100 and 200 are secured together along respective ones of their transversely extending end edges to form a double length emergency care blanket. FIGS. 14(*c*) and 14(*d*) depict the multi-layered arrangement for the emergency care blanket as discussed above with reference to 7. Emergency care blanket may, thus, assume a single width arrangement as shown in FIG. 14(*c*) whereby two flexible coverings are stacked one on top of another, or this stacked arrangement may be folded transversely along its middle to form a half width emergency care blanket as shown in FIG. 14(*d*).

Figure 15A:
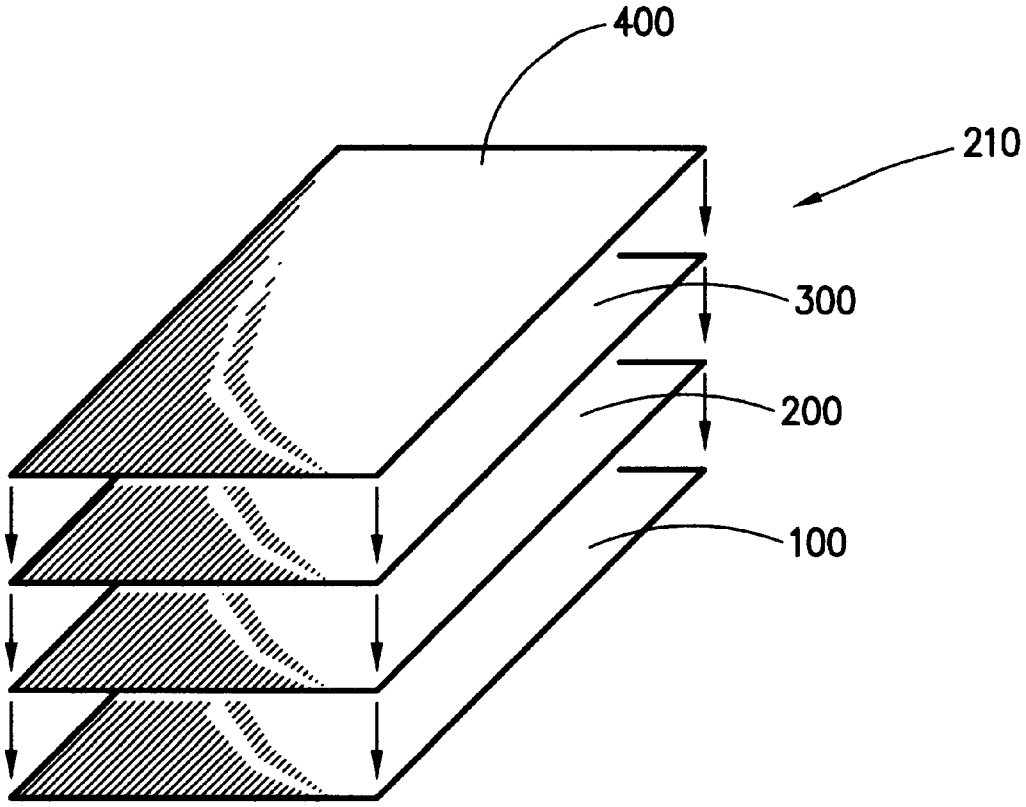
FIGS. 15(*a*)–15(*b*) illustrate two possible connected organizations for a plurality of the flexible coverings as contemplated by the modular emergency care blanket system according to the present invention.
Figure 15B:
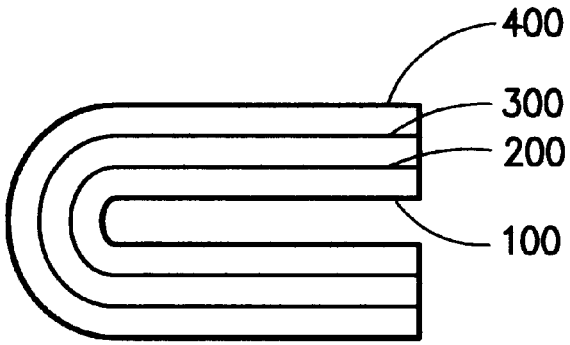

Based on the foregoing discussion as it related to an emergency care blanket according to the present invention, it should now be appreciated that surprisingly an extremely versatile, modular emergency care blanket system is also provided by the present invention. This modular emergency care blanket system 210, as generally illustrated in FIGS. 15(*a*) and 15(*b*) is also adapted to be selectively assembled into any one of a plurality of desired configurations to accommodate an individual in need of assistance and to protect the individual against prevailing environmental conditions. Modular emergency blanket system 210 comprises a plurality of first and second flexible coverings having the characteristics discussed above and a plurality of fasteners also having the characteristics discussed above. By incorporating a plurality of modular components into the emergency care blanket system 210, it should be understood that any number of first and/or second flexible coverings may be releasably interconnected into a plurality of desired configurations consisting of, but not limited to: stacked, edge-to-edge, confronting, co-extensive and contiguous. FIGS. 15(*a*) and 15(*b*) respectively show a stacked configuration for emergency care blanket system 210 and a folded state for this stacked system. Here, four flexible coverings 100, 200, 300 and 400 are interconnected along their respective edges, and the combined system may thereafter be folded as shown in FIG. 15(*b*).

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. An emergency care blanket adapted to be selectively assembled into a plurality of desired arrangements to accommodate an individual in need of assistance and to protect the individual from heat loss and against prevailing environmental conditions, comprising:

(a) an elongated first flexible covering having an associated pair of first covering transversely extending edges and an associated pair of first covering longitudinally extending edges, said first flexible covering further including an upper first covering surface and a lower first covering surface;

(b) an elongated second flexible covering having an associated pair of second covering transversely extending edges and an associated pair of second covering longitudinally extending edges, said second flexible covering further including an upper second covering surface and a lower second covering surface;

(c) a plurality of fasteners disposed on each of said first and second flexible coverings, each of said fasteners including two fastening structures with each of said fastening structures projecting from opposite respective ones of the upper surface and lower surface of its associated one of said first and second flexible coverings, whereby selected ones of said fastening structures are operative to matably engage selected other ones of said fastening structures so that said first and second flexible coverings may be releasably secured thereby to assemble said emergency care blanket into a fastened state characterized by one of said plurality of desired arrangements; and (d) a plurality of transversely spaced apart pairs of litter handles disposed on the upper surface of said first flexible covering, each of said spaced apart pairs of litter handles interconnected by strap portions which transversely span across a mid portion of said upper first covering surface to provide added reinforcement during transportation of the individual.

2. An emergency care blanket according to claim 1 wherein one of said first flexible covering and said second flexible covering is fabricated from a thermally insulating material.

3. An emergency care blanket according to claim 2 including a weather resistant, yet breathable, shell layer intimately bonded to said thermally insulating material such that a dead air space is formed thereby to trap air therebetween to provide added insulation to said emergency care blanket.

4. An emergency care blanket according to claim 1 wherein one of said first flexible covering and said second flexible covering is fabricated from a weather resistant material.

5. An emergency care blanket according to claim 4 wherein said weather resistant material is fire resistant.

6. An emergency care blanket according to claim 1 wherein said second flexible covering is foldable into a folded state and said first flexible covering is foldable into a storable state, and including a pocket disposed on said upper first covering surface which is sized to receive said second flexible covering when said second flexible covering is in the folded state.

7. An emergency care blanket according to claim 6 wherein said pocket is formed from a meshing and a margin of said pocket is operative to releasably engage said first upper surface to define a mouth through which said second flexible covering may be received.

8. An emergency care blanket according to claim 6 including at least one strap member secured to said first upper surface which is adapted to surround said first flexible covering and retain said first flexible covering in the stored state.

9. A emergency care blanket according to claim 1 including a hood releasably attachable to said first flexible covering.

10. An emergency care blanket according to claim 9 wherein said hood is fabricated from a thermally insulating material to which is affixed a weather resistant, yet breathable, shell layer.

11. An emergency care blanket according to claim 1 including a plurality of transversely spaced apart pairs of litter handles disposed on the upper surface of said second flexible covering, each of said spaced apart pairs of litter handles associated with said second flexible covering interconnected by strap portions which transversely span across a mid portion of said upper second covering surface to provide added reinforcement during transportation of the individual.

12. An emergency care blanket according to claim 11 wherein the plurality of fasteners associated with said first flexible covering are located on transversely extending and longitudinally extending edge margins thereof, and wherein the plurality of litter handles associated with said first flexible covering are located on the mid portion of said upper first covering surface.

13. An emergency care blanket according to claim 12 wherein the plurality of fasteners associated with said second flexible covering are located on transversely extending and longitudinally extending edge margins thereof, and wherein the plurality of litter handles associated with said second flexible covering are located on the mid portion of said upper second covering surface.

14. An emergency care blanket adapted to be selectively assembled into a plurality of desired arrangements to accommodate an individual in need of assistance and to protect the individual from heat loss and against prevailing environmental conditions, comprising:

(a) an elongated first flexible covering having an associated pair of first covering transversely extending edges and an associated pair of first covering longitudinally extending edges, said first flexible covering further including an upper first covering surface and a lower first covering surface;

(b) an elongated second flexible covering that is of the same size and shape as said first flexible covering, said second flexible covering having an associated pair of second covering transversely extending edges and an associated pair of second covering longitudinally extending edges, said second flexible covering further including an upper second covering surface and a lower second covering surface;

(c) a plurality of fasteners, each of said fasteners including two fastening structures with each of said fastening structures projecting from opposite respective ones of the upper surface and lower surface of its associated one of said first and second flexible coverings, whereby selected ones of said fastening structures on said first flexible covering are operative to matably engage selected other ones of said fastening structures on said second flexible covering so that said first and second flexible coverings may be releasably secured thereby to assemble said emergency care blanket into a fastened state characterized by one of said plurality of desired arrangements; and (d) a first pair of draw cords positioned on said first flexible covering at an inset distance from each transversely extending end edge thereof; and (e) a second pair of draw chords positioned on said second flexible covering in proximity to each transversely extending end edge thereof, whereby when said emergency care blanket is assembled into a fastened state wherein said first and second flexible coverings are in facing relationship to one another, opposed ones of said first and second pairs of draw chords may be selectively manipulated to provide at least two separate seal regions to better protect the individual against the prevailing environmental conditions.

* * * * *